US009260120B2

(12) United States Patent
Opelt et al.

(10) Patent No.: US 9,260,120 B2
(45) Date of Patent: Feb. 16, 2016

(54) DEVICES, SYSTEMS AND METHODS FOR ENGAGING AND DISENGAGING RAILCAR WHEELS AND FOR CONTROLLING TRAVEL OF RAILCAR

(71) Applicant: AAA Sales & Engineering, Inc., Oak Creek, WI (US)

(72) Inventors: Kurtis James Opelt, Germantown, WI (US); Neal W Becker, Greenfield, WI (US); Gene Z Gokhman, Mequon, WI (US)

(73) Assignee: Precision Rail and Mfg., Inc., Oak Creek, WI (US)

( * ) Notice: Subject to any disclaimer, the term of this patent is extended or adjusted under 35 U.S.C. 154(b) by 317 days.

(21) Appl. No.: 13/935,177

(22) Filed: Jul. 3, 2013

(65) Prior Publication Data

US 2015/0007743 A1 Jan. 8, 2015

(51) Int. Cl.
*B61K 7/20* (2006.01)

(52) U.S. Cl.
CPC ..... *B61K 7/20* (2013.01)

(58) Field of Classification Search
CPC ..... B61K 7/18; B61K 7/00; B61K 7/20; B61K 7/16
USPC ..... 104/249, 257, 259, 260; 213/221
See application file for complete search history.

(56) References Cited

U.S. PATENT DOCUMENTS 150,249 A * 4/1874 Lloyd ..... 213/221
2,175,286 A 10/1939 Finch
2,807,220 A 9/1957 McDowell
2,945,454 A 7/1960 Beck
3,128,721 A 4/1964 McGowan
3,215,091 A 11/1965 Hayes
3,799,064 A * 3/1974 Kikuchi et al. ..... 104/256
3,807,532 A 4/1974 Molt
3,828,688 A 8/1974 Bradbury
3,924,539 A 12/1975 Wladis
3,944,174 A 3/1976 Flinn
4,080,904 A * 3/1978 Lofink et al. ..... 104/162
4,216,724 A 8/1980 Grillet
4,325,307 A 4/1982 Bick
4,480,723 A 11/1984 Ingvast et al.
4,498,561 A 2/1985 Sanders
4,739,863 A 4/1988 Stauffer
5,211,115 A 5/1993 Maier et al.
5,388,525 A 2/1995 Bodkin
5,836,252 A 11/1998 Roick
5,947,030 A 9/1999 Spieldiener et al.
6,152,042 A 11/2000 Barry et al.
6,155,178 A 12/2000 Pease
6,520,298 B1 2/2003 Meuters et al.
6,773,221 B2 8/2004 Belongia et al.

(Continued)

*Primary Examiner* — Mark Le
(74) *Attorney, Agent, or Firm* — Andrus Intellectual Property Law, LLP

(57) ABSTRACT

Devices, a system and a method for controlling travel of a railcar along a set of rails are provided, the railcar having wheel treads that ride on the rails. A railcar stop is selectively movable between a first position wherein the railcar is free to travel along the rails, and a second position wherein the railcar stop is configured to engage the tread of the at least one of the wheels to thereby stop and prevent travel of the railcar in at least a first direction along the rails. The railcar stop is further configured to be selectively movable in the first direction along the rails from the second position to a third position to thereby disengage the railcar stop from the tread of the least one of the wheels.

32 Claims, 11 Drawing Sheets

(56) References Cited

U.S. PATENT DOCUMENTS

| | | | | |
|---|---|---|---|---|
| 7,717,043 | B2 | 5/2010 | Rastegar et al. | |
| 8,020,494 | B2 | 9/2011 | Smith et al. | |
| 8,079,309 | B2 | 12/2011 | Heyden et al. | |
| 8,485,105 | B2 | 7/2013 | Heyden et al. | |
| 8,485,107 | B2 | 7/2013 | Heyden et al. | |
| 2007/0062407 | A1 | 3/2007 | Kickbush | |
| 2009/0031914 | A1 | 2/2009 | Hahn et al. | |
| 2010/0083865 | A1 | 4/2010 | Heyden et al. | |
| 2011/0120340 | A1 | 5/2011 | Smith et al. | |
| 2011/0232521 | A1* | 9/2011 | Heyden et al. | 104/249 |
| 2011/0265679 | A1 | 11/2011 | Smith et al. | |
| 2012/0012027 | A1 | 1/2012 | Thyssen, Jr. | |
| 2012/0055368 | A1 | 3/2012 | Heyden et al. | |

* cited by examiner

DEVICES, SYSTEMS AND METHODS FOR ENGAGING AND DISENGAGING RAILCAR WHEELS AND FOR CONTROLLING TRAVEL OF RAILCAR

CROSS REFERENCES TO RELATED PATENT AND APPLICATIONS

The present application relates to U.S. Pat. No. 8,079,309 issued Dec. 20, 2011 and co-pending U.S. patent application Ser. Nos. 12/748,089, filed Mar. 26, 2010 and 13,295,888, filed Nov. 14, 2011, each of which is entirely incorporated herein by reference.

BACKGROUND AND SUMMARY

The present application relates to railcar stop devices, systems and methods for controlling travel of one or more railcars along a set of rails, for example, on a sloped surface in a railway yard. In one example, a system and a device includes two railcar stops, each of which is selectively movable between a first position wherein the railcar is free to travel along the set of rails, and a second position wherein the railcar stop is configured to engage the tread of at least one of the wheels of the railcar to thereby stop and prevent travel of the railcar in at least a first direction along the rails. Each railcar stop is further configured to be selectively movable in the first direction along the rails from the second position to a third position to thereby disengage the railcar stop from the tread and the flange of the at least one of the wheels. The railcar stops are separately actuated by first and second drive arrangements coupled to a mounting frame that is selectively movable relative to the rails.

BRIEF DESCRIPTION OF THE DRAWINGS

Reference is made herein to the following drawing figures.

DETAILED DESCRIPTION OF THE DRAWINGS

In the following description, certain terms have been used for brevity, clearness and understanding. No unnecessary limitations are to be implied therefrom beyond the requirement of the prior art because such terrns are used for descriptive purposes only and are intended to be broadly construed. The different systems and devices described herein may be used alone or in combination with other systems and devices. It is to be expected that various equivalents, alternatives and modifications are possible within the scope of the pending claims.

Figure 1:
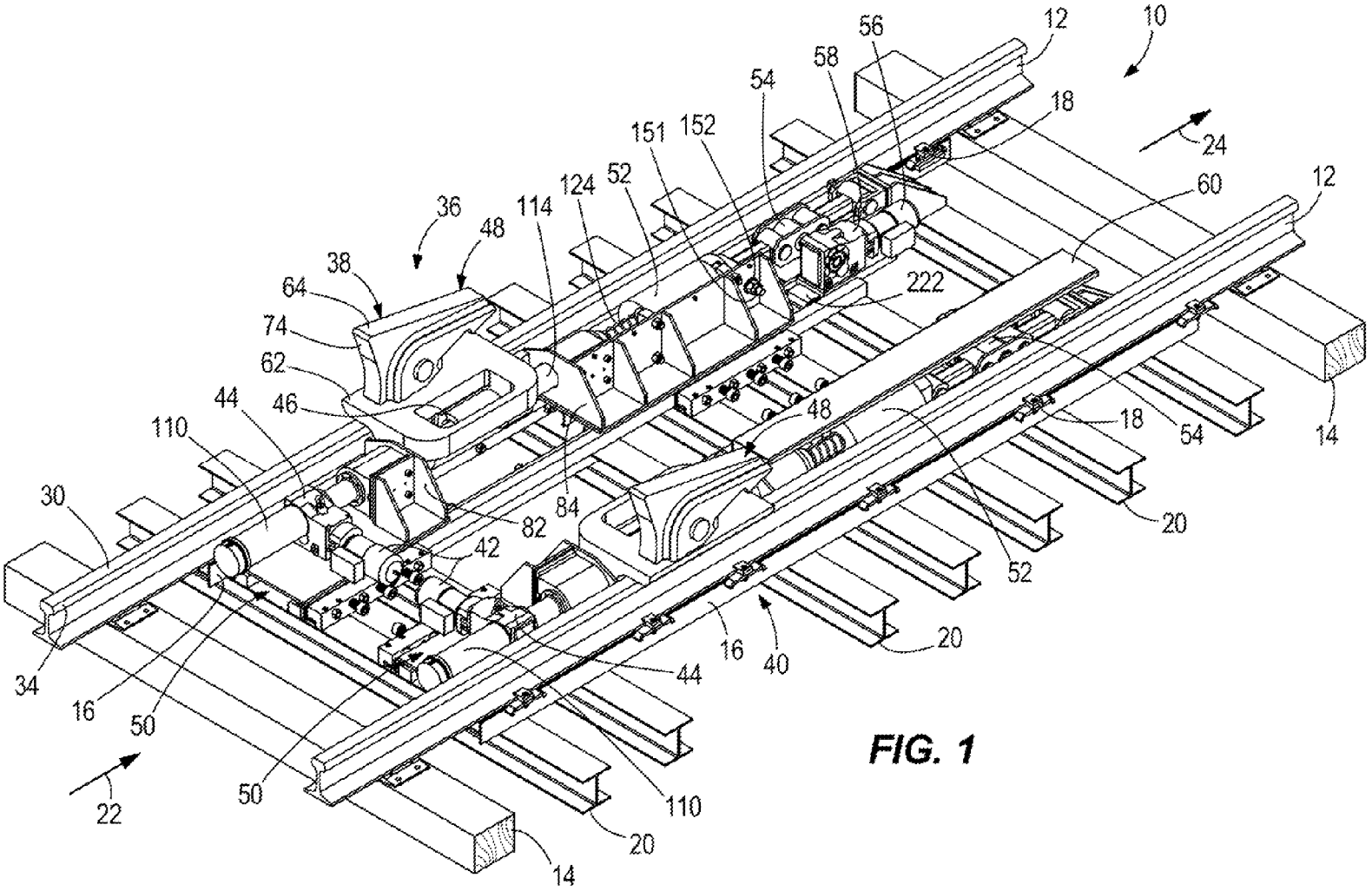
FIG. 1 is a perspective view of a section of railroad tracks provided with a system for controlling travel of a railcar.

FIG. 1 depicts a section of railroad tracks 10 that include a pair of conventional rails 12 mounted on railroad, ties 14 that lie on a railroad bed. The rails 12 are also mounted on a pair of elongated W-beams 16 by a set of spaced apart holddown brackets 18 that are fixed to the top of the beams 16. The beams 16 supporting the rails 12 are secured transversely upon a set of I-beams 20, and the beams 16, 20 together form a stationary frame supported on the railroad bed between the ties 14. The rails 12 continue in uptrack and downtrack directions with railcars entering the section of tracks 10 in the direction of arrow 22, and exiting the section of tracks 10 in the direction of arrow 24.

Figure 3:
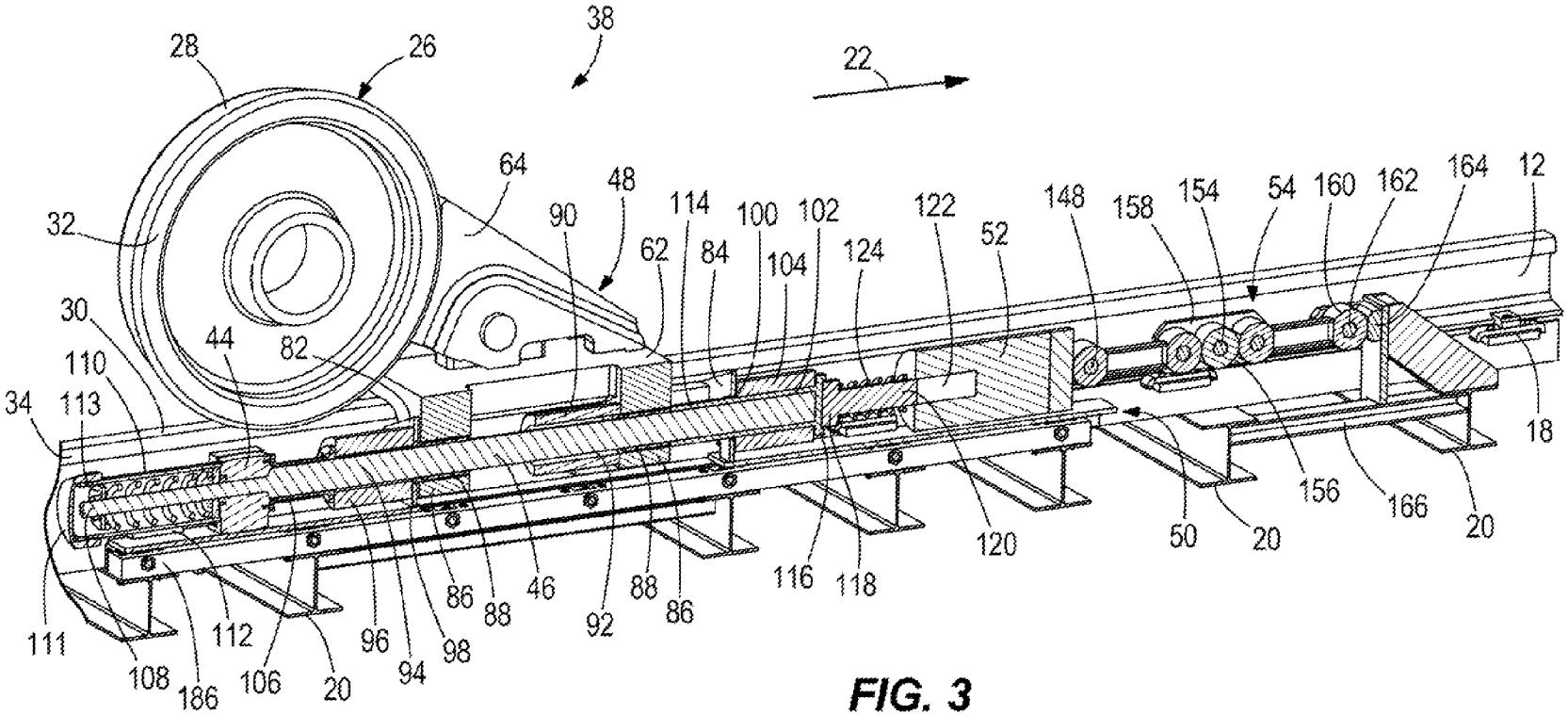
FIG. 3 is a perspective view in partial longitudinal cross section of the railcar stop upon engagement with a moving railcar wheel.

Railcars typically include a set of wheels, an example of one of which is shown at 26 in FIG. 3. Each wheel 26 includes a tread 28 that is configured to ride along the top surface 30 of one of the rails 12. Each wheel 26 further includes a flange 32 that extends transversely outwardly from the tread 28. The flange 32 is configured to engage an inner side surface 34 of the respective rail 12.

FIG. 1 also depicts a system 36 mounted to the tracks 10 for controlling travel of a railcar along the rails 12. The system 36 includes two identical devices or railcar stops 38, 40 which are substantially minor images of each other, and are positioned adjacent to each other between the rails 12. Each railcar stop 38, 40 includes a first drive arrangement including a first motor 42 drivingly coupled to a first gearbox 44 that is configured to cause clockwise and counterclockwise rotation of a connecting rod 46 and a wing 48 that is connected to and rotates as the connecting rod 46 rotates. Each railcar stop 38, 40 further includes a mounting frame 50 mounted for linear back and forth movement relative to the rails 12, a shock absorber 52, a linkage mechanism 54 and a second drive arrangement including a second motor 56 drivingly coupled to a second gearbox 58 configured to selectively move the mounting frame 50. The mounting frame 50 serves as a mounting surface for the first motor 42, the first gearbox 44, the connecting rod 46, the wing 48, the shock absorber 52, the linkage mechanism 54, the second motor 56 and the second gearbox 58. An elongated protective cover 60 (one of which is shown in FIG. 1) is secured on a rear portion of each mounting frame 50 over the shock absorber 52 and the linkage mechanism 54. Some of the discussion provided below is directed to only one of the railcar stops 38, 40, but such discussion applies equally to both railcar stops 38, 40.

Figure 2:
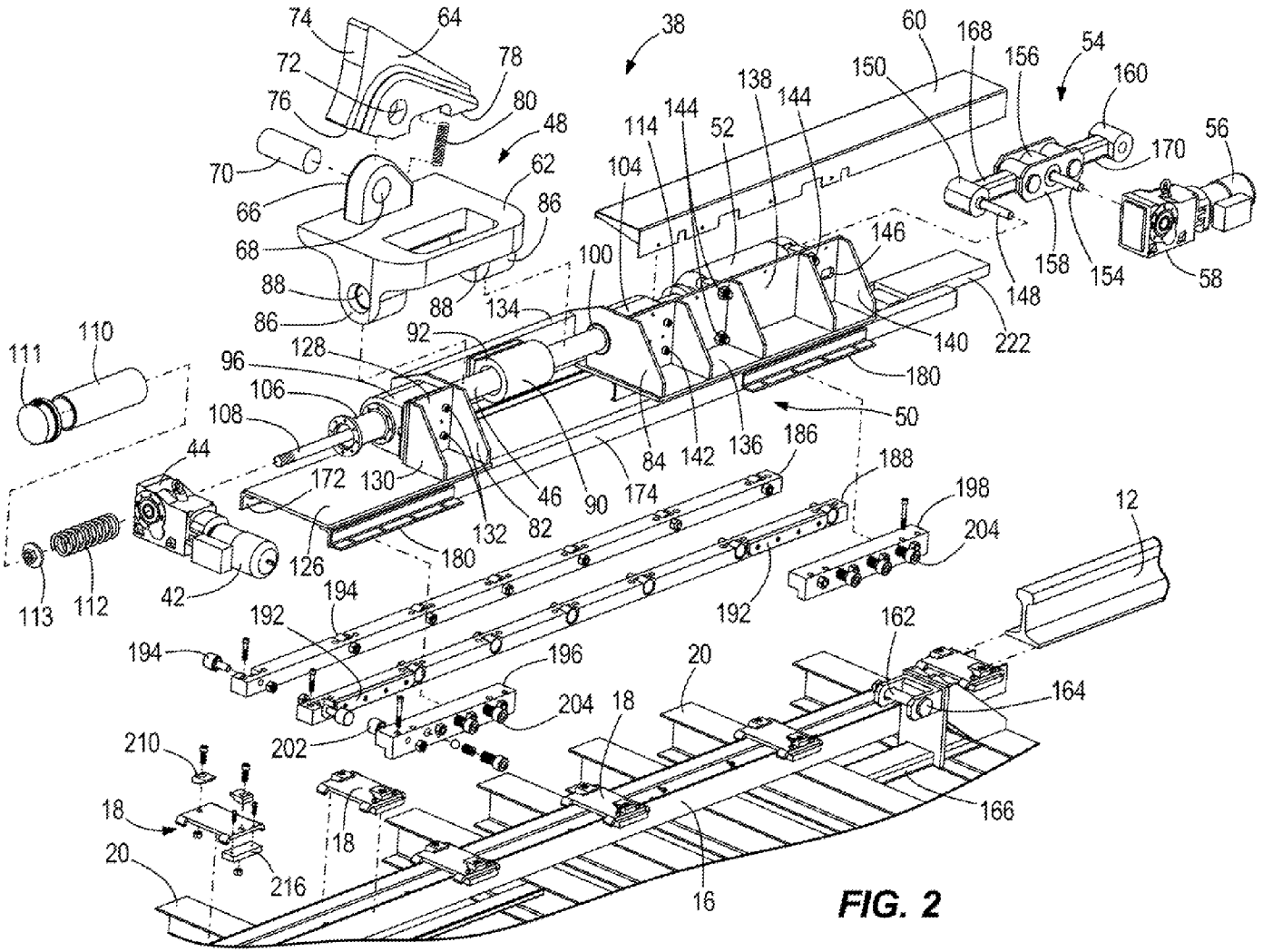
FIG. 2 is a perspective exploded view of a railcar stop associated with the system of FIG. 1, and showing certain elements positioned similar to those shown in FIG. 4.

FIG. 2 shows an example of the railcar stop 38 in more detail. The wing 48 is configured to engage the wheel 26 to stop travel of the railcar along one of the rails 12. More specifically, the wing 48 includes a base 62 and an upwardly extending fin 64. The fin 64 is attached to the wing 48 by means of a lobe 66 that extends upwardly from the base 62 into a hollow interior of the fin 64, and thus defines an axial bearing 68 that is sized and shaped to receive and bear a pivot pin 70. Thereafter, the pivot pin 70 is inserted through an aligned aperture 72 in the fin 64 and the axial bearing 68 to pivotally couple the fin 64 to the base 62. A fastener (not shown) is used to couple the pin 70, the base 62 and the fin 64 together.

Figure 4:
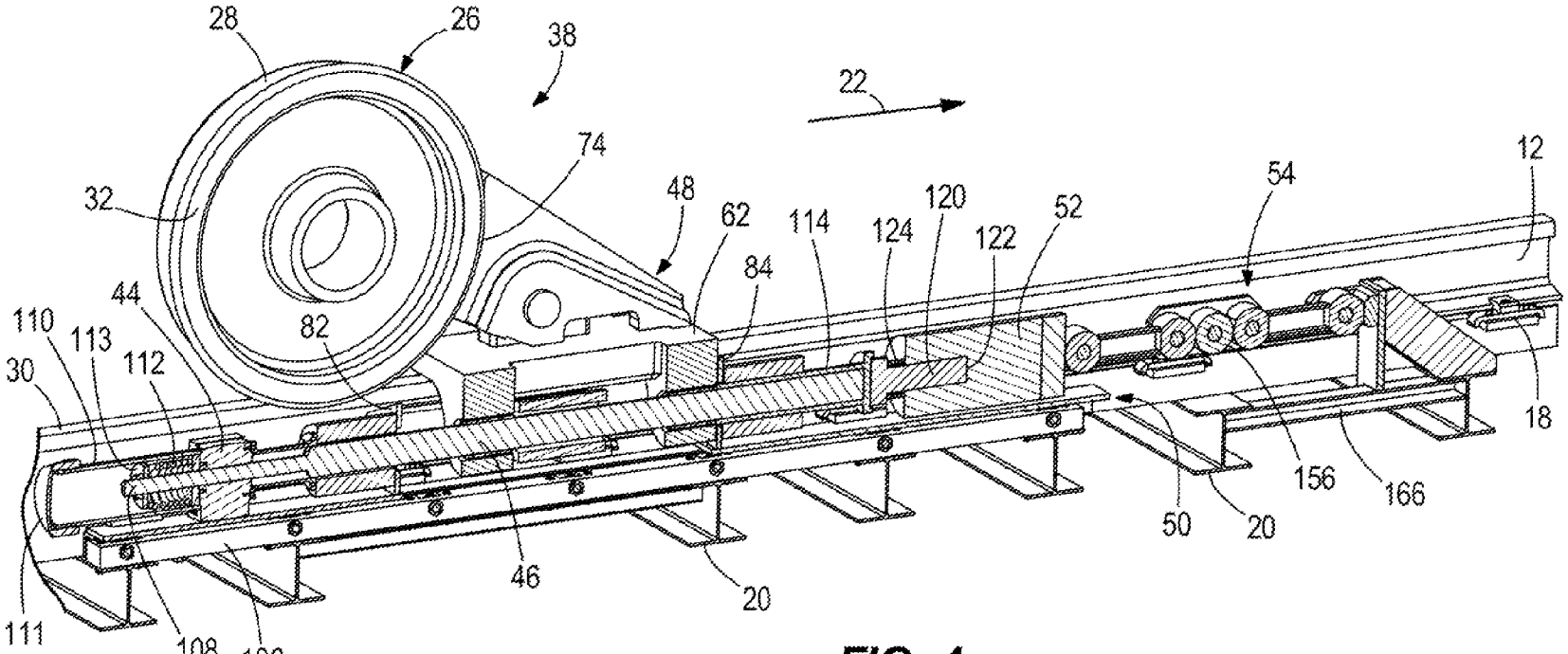
FIG. 4 is a view similar to FIG. 3 showing the railcar stop after further engagement with the railcar wheel.
Figure 5:
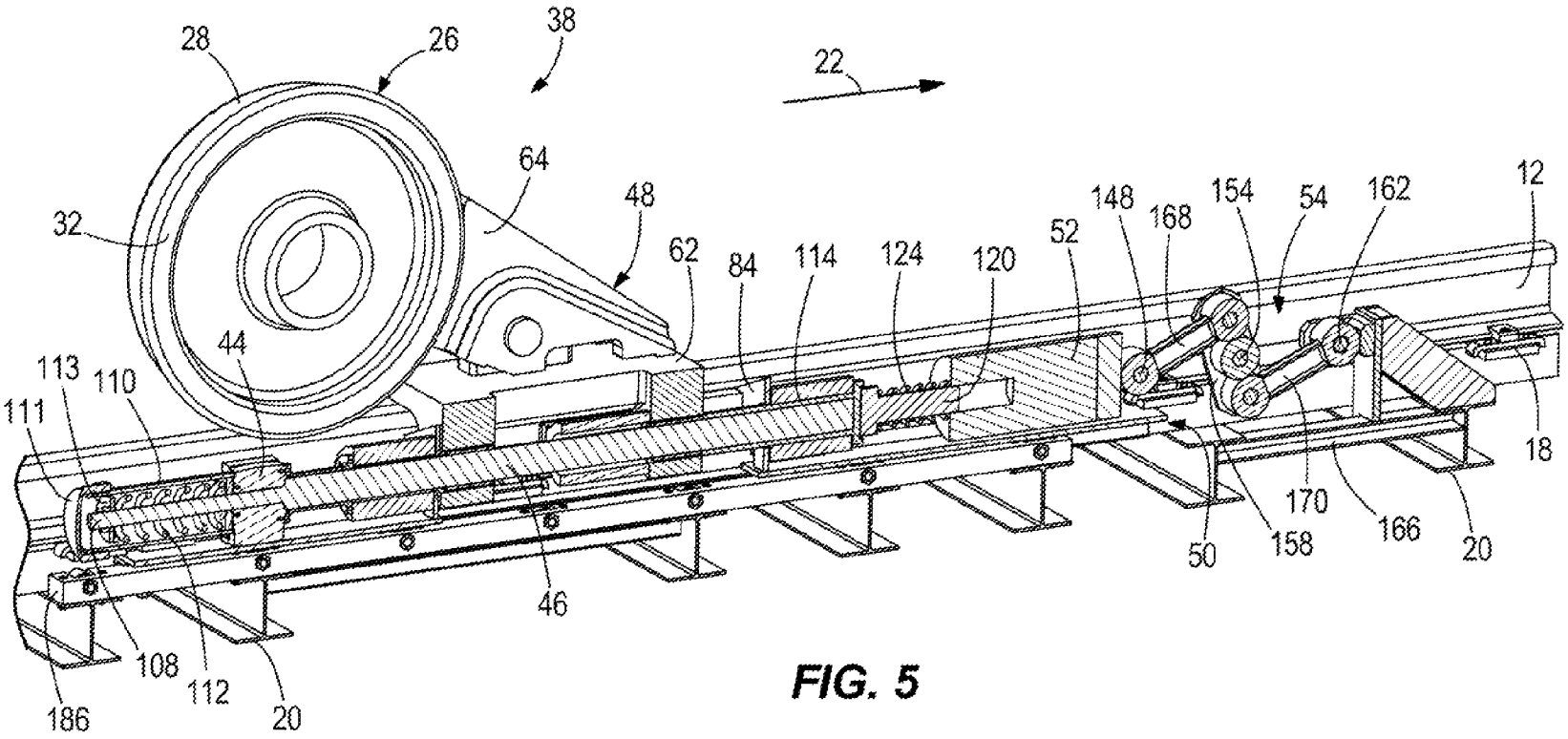
FIG. 5 is a showing FIG. 3 view similar to FIG. 3 showing the railcar stop before disengagement from the railcar wheel.

The fin 64 is generally triangular in shape and has a curved bearing surface 74, a front abutment surface 76 and a rear abutment surface 78, A spring 80 resides in a bore of the lobe 66, and is biased against the fin 64 to cause the fin 64 to pivot between a first position wherein the front abutment surface 76 abuts the base 62, and the rear abutment surface78 is spaced from the base 62, and a second position in which the front abutment surface 76 is spaced from the base 62 and the rear abutment surface 78 abuts the base 62. Engagement of the wheel tread 28 with the bearing surface 74 causes the fin 64 to pivot from the first position, such as shown in FIG. 1, to the second position, such as shown in FIGS. 3-5, until the rear abutment surface 78 contacts the base 62. This type of arrangement is more fully described in applicant's co-pending U.S. patent application Ser. No. 12/748,089, incorporated herein by reference.

The wing 48 is further configured to be pivotally and slidably mounted between spaced apart front and rear plates 82, 84, respectively, fixed on and extending across the mounting frame 50. To enable this movement, the base 62 of the wing 40 is constructed with a pair of aligned, downwardly depending knuckles 86 having through-holes 88. The knuckles 86 are designed to fit on either side of an intermediate knuckle 90 fixed on the mounting frame 50, and provided to align with through-holes 88. Referring to FIGS. 3-6, the through-holes 88 and the bore 92 are in further alignment with a bore 94 formed in a forward knuckle 96, a hole 98 formed in the front plate 82, a hole 100 formed in the rear plate 84, and a bore 102 formed in a rearward knuckle 104 which is fixed in spaced relationship with the forward knuckle 96 to the mounting frame 50. The aligned through-holes 88, the bores 92, 94, 102 and the holes 98, 100 define a throughway for receiving, the connecting rod 46. One or more keys (not shown) are embedded in the connecting rod 46 and are configured to engage corresponding key slots (not shown) formed in the through-holes 88 of the knuckles 86. This type of mated arrangement is shown in more detail in applicant's U.S. Pat. No. 8,079,309 incorporated herein by reference. According to the above described arrangement, the wing 48 and the connecting rod 46 are interlocked to rotate and then slide together back and forth in different directions about a longitudinal axis defined by the connecting rod 46 which is parallel to a longitudinal axis of the rail 12.

With further reference to FIGS. 3-6, a forward portion of the connecting rod 46 is rotatable and slidable within a tubular, flanged collar 106 fixed between the gearbox 44 and the forward knuckle 96. The forward portion of the connecting rod 46 includes a driven end 108 which is formed with a reduced diameter as compared to the remainder of the connecting rod 46. The driven end 108 is designed to be received in the gearbox 44, such as by means of a spline coupling arrangement (not shown), so that the connecting rod 46 is rotated by and slidable back and forth in the gearbox 44. Outer pipe section 110 is provided to cover the driven end 108 of the connecting rod 46 along, with an outer cap 111. The pipe section 110 can be provided with oil for lubrication and protection of the system 36. This type of arrangement for the gearbox 41 is also described in applicants U.S. Pat. No. 8,079,309 which is incorporated herein by reference. A coil spring 112 encircles driven end 108 and has one end engaged against a stop 113 attached to a forward extremity of driven end 108 and another end engaged against a rear end of pipe section 110 which is secured to the front of gearbox 44. The spring 112 normally provides constant biasing force in a direction opposite of railway travel so as to position the connecting rod 46 and wing 48 in an initial operating position shown in FIG. 3 when it is desired to prevent railcar travel along the rail.

A rear portion of the connecting rod 46 includes and is received and retained within a tubular sleeve 114 which is rotatable and slidable relative to the bole 100 formed in rear plate 84 and the bore 102 formed in the rearward knuckle 104. The sleeve 114 has an enlarged end 116 which is in continuous engagement with a head 118 of a piston rod 120 that is extendable from and retractable into a recess 122 of the shock absorber 52 during operation of the system 36. The recess 122 is typically provided with damping fluid as is well known. Continuous engagement between the sleeve end 116 of rod 46 and the piston bead 118 is provided by a coil spring 124 encircling the piston rod 120 and having one end engaged against the piston head 118 and an opposite end engaged against a forward casing wall of the shock absorber 52. The spring 124 provides a constant biasing force in a direction opposite that of railway travel so as to position the wing 48 with the connecting rod 46 in the initial operating position shown in FIG. 3 when it is desired to prevent railcar travel along, the rail 12. In the example shown, the spring 124 is sized and designed to provide a lesser biasing force on connecting rod 46 and wing 48 than spring 112.

As shown in FIG. 2, the mounting frame 50 includes a forward platform 126 upon which the gear motor 42 and gearbox 44 are suitable anchored via for example a reinforcing gusset 130. A forward mounting, wall 128 rises upwardly from the forward platform 126. and is rigidly connected between the front plate 82 and the reinforcing, gusset 130. The forward knuckle 96 is supported on the forward platform 126 and secured to the forward mounting wall 128 by fasteners 132. An intermediate mounting wall 134 extends between the plates 82, 84, and provides a mounting surface for fixing the intermediate knuckle 90 thereto. A rearward platform 136 is spaced from the forward platform 126, and a rearward wall 138 extends upwardly from the rearward platform 136. A series of reinforcing gussets 140 extends between one side of the rearward mounting wall 138 and the rearward platform 136, The rearward knuckle 104 is supported on the rearward platform 136, and is attached to the rearward mounting wall 138 by fasteners 142. The shock absorber 52 is also supported on the rearward platform 136, and is secured to the rearward mounting wall 138 by fasteners 144.

A back end of the rearward mounting wall 138 is formed with an opening 146 for receiving a forward connecting pin 148 extending laterally from a forward barrel end 150 of the linkage mechanism 54. As seen in FIG. 1, the connecting pin 148 is coupled to the rearward mounting wall 138 by a bolt 151 and a nut 152. Referring back to FIG. 2, a connecting pin 154 extends laterally from a cylindrical barrel 156 mounted in a link coupler 158 of the linkage mechanism 54, and is designed to be received in and selectively driven by the second gearbox 58. As best seen in FIG. 3, a rear barrel end 160 of the linkage mechanism 54 is configured to be pivotally mounted by a connecting pin 162 to a bracket assembly 164 fixed to a bar 166 extending between a pair of I-beams 20 at the rear of the section of the railroad tracks 10 for the system 36.

The linkage mechanism 54 as depicted in FIG. 2 has a pair of links 168, 170 which are pivotally mounted relative to the link coupler 158. As will be fully appreciated hereafter, the linkage mechanism 54 is configured to move between a rigid locked condition, as shown, for example, in FIGS. 3 and 4, and a buckled release condition, such as shown, for example, in FIGS. 5 and 6, during operation of the system 36.

Figure 7:
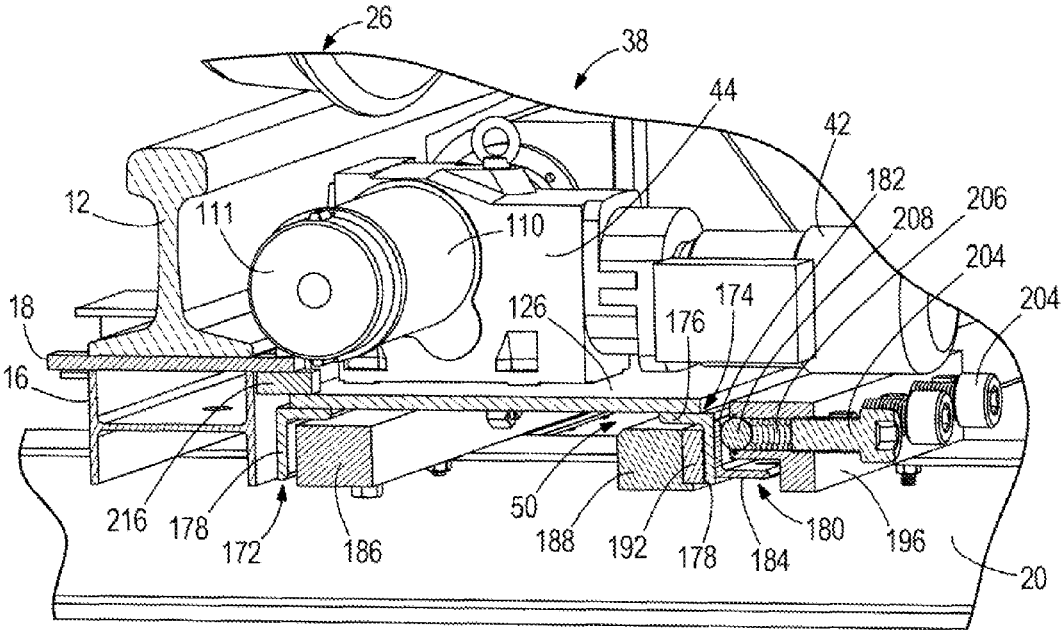
FIGS. 7-9 are sectional views taken on or adjacent line 7-7 of FIG. 10 showing various details of each movable mounting frame of the system.
Figure 8:
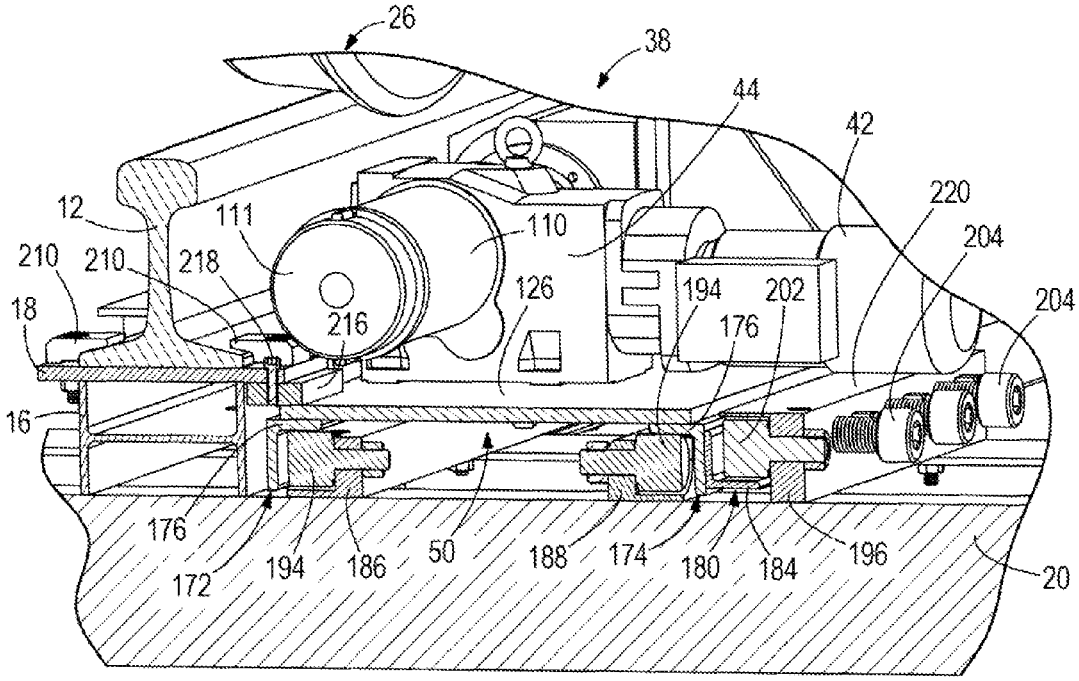

Referring now to FIGS. 2 and 7-9, the mounting frame 50 also includes a pair of spaced apart, longitudinally extending side rails 172, 174 which have an inserted L-shape in cross section. Each of the side rails 172, 174 has a horizontally extending leg 176 which is fixed, such as by welding, to the bottom surface of the forward platform 126 and the rearward platform 136 along the side edges thereof Each of the side rails 172, 174 also has a vertically extending leg 178 having a bottom end which is spaced above a top surface of the underlying I-beams 20. L-shaped bearing members 180, each having a vertically extending leg 182 and a horizontally extending leg 184, are fixed, such as by welding, to outer surfaces of the leg 178 along forward and rearward portions thereof. A pair of elongated bars 186, 188 are secured to the I-beams 20 by fasteners 190 (FIG. 9) inside the side rails 172, 174. Bearing strips 192 are provided on forward and rearward portions of the outer side surfaces of the bar 188 for contact with the vertical leg 178 of side rail 174. As seen in FIG. 8, the bars 186, 188 carry a set of spaced apart rollers 194 which are engageable with undersides of the legs 176 of side rails 172, 174. Another pair of bars 196, 198 (FIG. 2) are fixed by fasteners 200 (FIG. 9) outside the bearing members 180. The bars 196,198 are provided with a series of inwardly extending rollers 202 (FIG. 8) which are engageable with legs 184 of the bearing strips 180. In addition, as seen in FIG. 7, the bars 196, 198 include a series of screwthreaded fasteners 204 each of which interacts with a spring 206 and a steel ball 208 that is biased against the leg 182 of bearing member 180. Turning each fastener 204 against a spring 206 provides a biasing force transmitted by the ball 208 against the bearing member 180 and the side rail 174.

Figure 9:
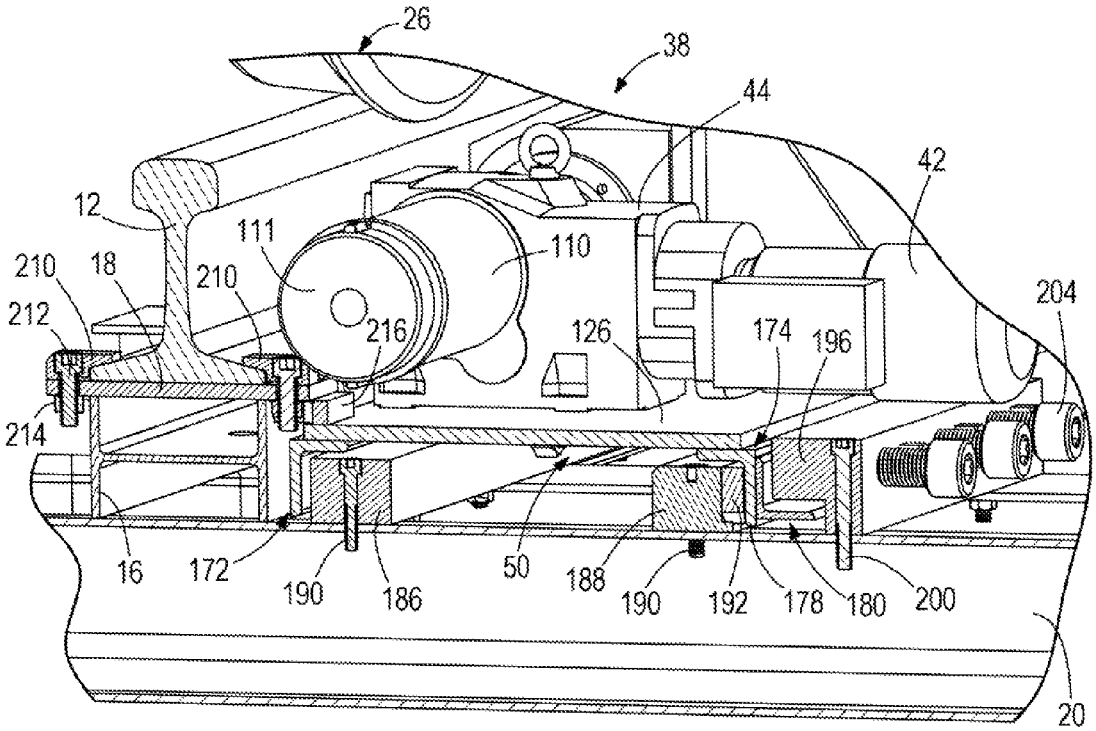

As further seen in FIGS. 7-9, each holddown bracket 18 includes a pair of holddown bars 210 which are clamped against the bottom flanges of each rail 12 and held securely thereto by a bolt 212 and nut 214. Each holddown bracket 18 also includes a bearing plate 216 which is secured by a fastener 218 to and beneath the bracket 18. Each bearing plate 216 is positioned against the upper surfaces of the forward platform 126 and the rearward platform 136 at spaced apart locations adjacent the rail 12.

By the arrangement described above, it should be appreciated that each mounting frame 50 is enabled to slide back and forth by means of the rollers 194, 202 relative to the bars 186, 188, 196, 198 as well as the beam 16 and the I-beams 20. As the mounting frame 50 slides back and forth, various elements described above form a directional guide arrangement for restricting the path of mounting frame movement. More specifically, the fasteners 204, the springs 206, and the balls 208 cooperate to restrict lateral motion of the mounting frame 50. in addition, each mounting frame 50 is restricted against upward movement by engagement of the rollers 202 with upper surfaces 220 (FIG. 8) of the bars 196, 198. Each mounting frame 50 is further restricted against upper movement by means of the bearing plate 216.

Referring again to FIG. 2, the rearward end of each mounting frame 50 includes a base 222 which is slidably mounted, such as by a dovetail arrangement, between the side rails 172, 174. The base 222 serves as a mounting surface for anchoring the gear motor 56 and the gearbox 58 thereto.

Figure 13:
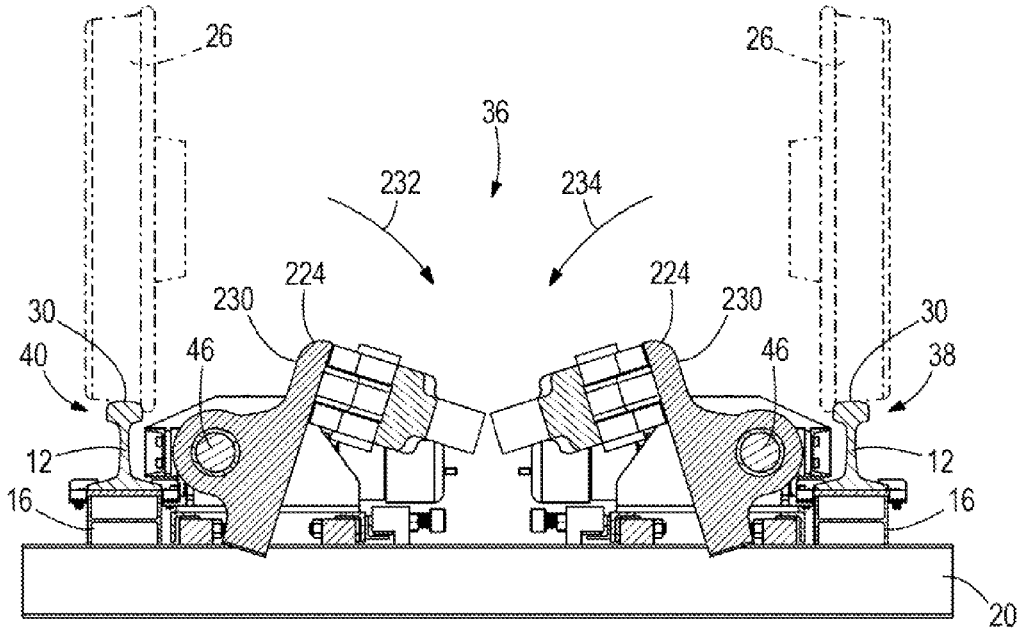
FIG. 13 is a sectional view of the adjacent railcar stops of the system in lowered, inactive positions.

FIG. 13 shows the system 36 with the devices 38, 40 in a lowered position wherein a railcar is allowed to fully travel through the section of railroad tracks 10 in the direction of arrows 22, 24 (FIG. 1). In the lowered position, the wings 48 are rotated inward towards each other about the longitudinal axes defined by the connecting rods 46. In the lowered position, the upper portion 224 of the wings 48 is positioned below the lowermost clearance point on the underside of the railcar (not shown) to allow for free passage of the railcar over the devices 38, 40.

Figure 12:
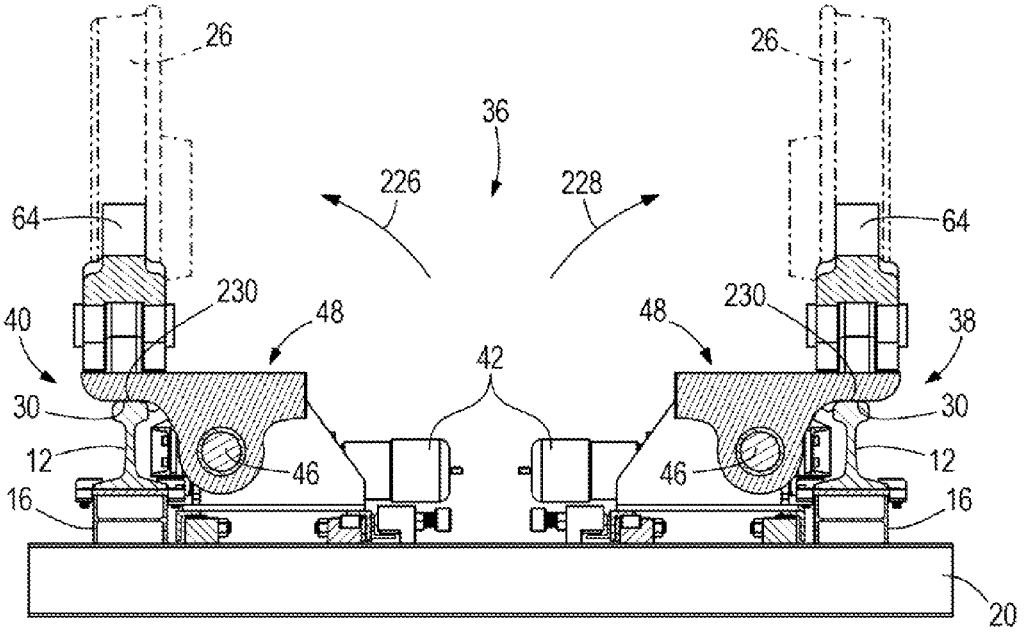
FIG. 12 is a sectional view taken on line 12-12 of FIG. 11 of the adjacent railcar stops of the system m raised, active positions.

FIG. 12 shows the system 36 in a raised position wherein the devices 38, 40 are configured to engage the treads 28 of the railcar wheels 26 to thereby prevent travel of the railcar along the section of tracks 10 in the direction of arrows 22, 24. During operation, the system 36 is moved from the lowered position (FIG. 13) to the raised position (FIG. 12) such as by emitting an actuating, signal from a controller to the gear motors 42. A controller as disclosed in applicant's U.S. Pat. No. 8,079,309 incorporated herein by reference, can be provided for controlling movement of the devices 38, 40. The motors 42 and the gearboxes 44 cause the connecting rods 46 to rotate towards their respective rails 12 as depicted by arrows 226, 228. As each connecting rod 46 rotates, the respective wing 48, which is coupled to the connecting rod 46 by the keyed connection, also rotates accordingly. Once the bottom surface 230 of each wing 48 is engaged with the top surface 30 of the corresponding rail 12. each railcar stop 38, 40 is fully rotated into the raised position.

FIG. 3 shows the railcar stop 38 in the raised position just after engagement with the moving, railcar wheel 26 in FIG. 3, the wing 48 is pivoted into a space between the front plate 82 and the rear plate 84 of the mounting frame 50 with the front end of the wing base 62 lying adjacent the front plate 82, and the connecting rod 46 being continuously biased by springs 112 and 124 to its forwardmost position in driving engagement with the gearbox 44. The springs 112 and 124 bias the wing 48 in the direction opposite arrow 22. The gear motor 56 and the gearbox 58 are de-energized to hold the linkage mechanism 54 in a rigid locked condition which maintains the shock absorber 52 and the mounting frame 50 in a stationary condition so that they cannot move relative to the rail 12 and the I-beams 20, A solenoid-operated locking pin (not shown) may also be employed to hold the linkage mechanism 54 in the locked condition. The gear motor 42, gearbox 44, shock absorber 52, gear motor 56, gearbox 58 and knuckles 90, 96, 104 are all held stationary with the mounting frame 50, while the connecting rod 46, the wing 48, the sleeve 114, the piston rod 120 and the springs 112 and 124 are enabled for slidable movement relative to the mounting frame 50.

Figure 10:
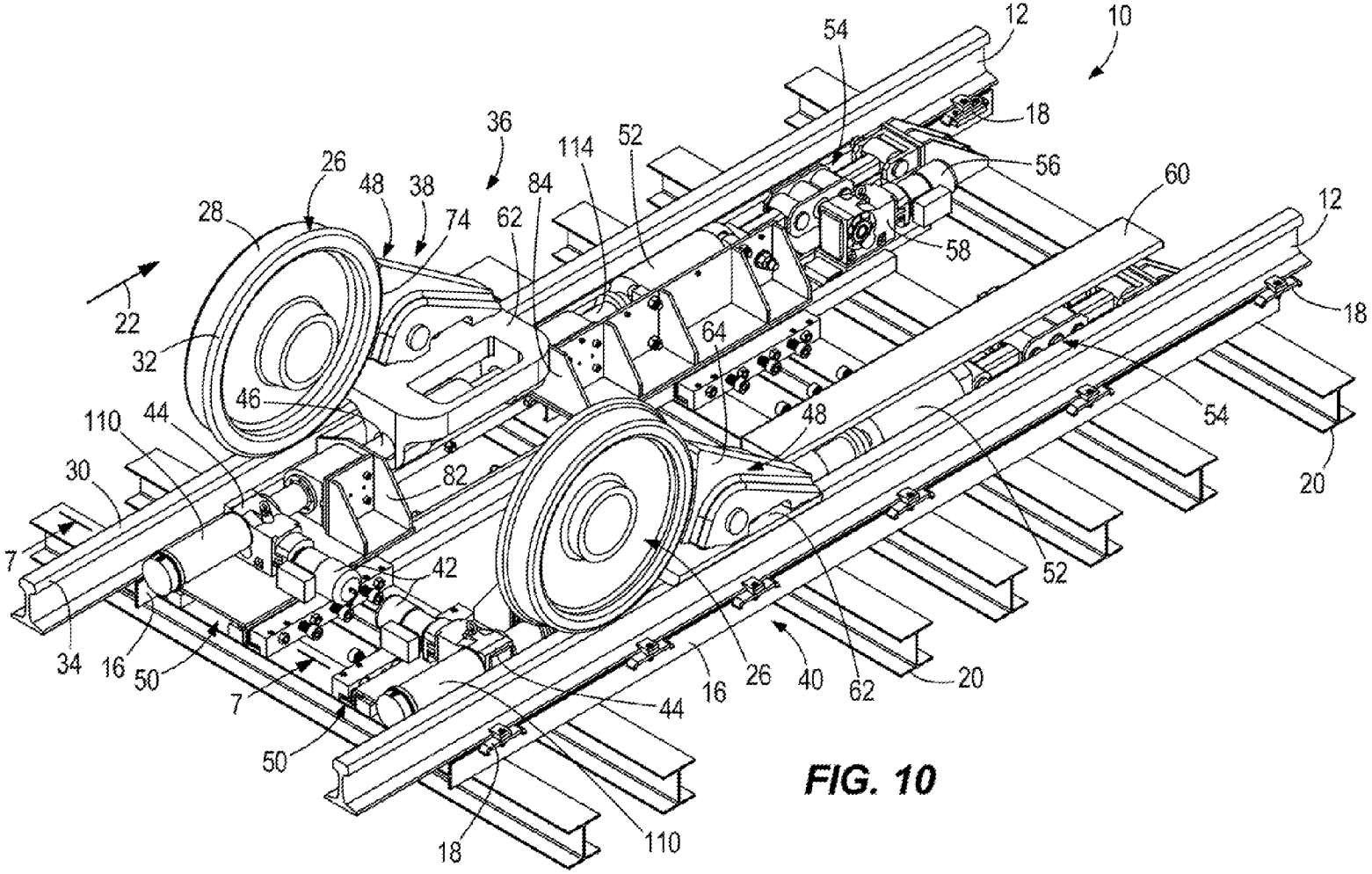
FIG. 10 is a perspective view of the system corresponding to FIG. 4.

As shown in FIGS. 4 and 10, when the tread 28 of the moving railcar wheel 26 has engaged the bearing face 74 of the wing 48, the momentum of the railcar and the wheel 26 thereof slidably pushes the wing 48, the connecting rod 46 and the tube 114 longitudinally along the track 10 in the direction of arrow 22. As the wing 48 is forced longitudinally in the direction of arrow 22, the springs 112 and 124 are compressed and the piston rod 120 slides into the fluid-filled recess 122 of the shock absorber 52. The springs 112 and 124 and the shock absorber 52 act to absorb the compressive pressure of the wheel 26 on the wing 48 and stabilize movement of the wing 48 in the longitudinal direction. Other shock absorbing devices could be employed to provide the shock absorbing function described. At this point, the wheel 26 can no longer advance along the rail 12. In practice, once the wheel 26 can no longer advance, the air brake of the railcar is typically applied to fully secure the railcar wheel 26.

To move the wing 48 from the raised position (FIG. 12) to the lowered position (FIG. 13) when railcar travel is to be restored, it is necessary to provide adequate separation between the wheel 26 and the wing 48. In certain situations where the grade of the railway bed permits, it is possible to move a railcar and the associated wheel 26 a distance opposite the direction of arrow 22 after which the wing 48 can be pivoted into the lowered position shown in FIG. 13 so that railcar travel is enabled. In order to move the device 38 to its lowered position, it is necessary to move the railcar and its wheel 26 a distance away from the wing 48 that is greater than a width of the wheel flange 32 so that the flange 32 clears the bearing face 74 of the fin 64 of wing 48.

However, the present disclosure contemplates the situation in which the locomotive driving the railcar does not have the power to cause separation of the wheel 26 from the wing 48 due to the incline of the railway bed or other unfavorable conditions. In such situations, the system 36 provides for selective and independent disengagement of the wing 48 relative to the stationary railcar wheel 26.

As illustrated in FIG. 5, when it is desired to move the device or railcar stop 38 from the raised position to the lowered position, a signal is first sent to the gear motor 56. The signal initiates operation of the gear motor 56 and the gearbox 58 which is drivingly coupled to the pin 154 of the linkage mechanism 54. Initial movement of the pin 154 driven by gearbox 58 will cause the linkage mechanism 54 to move from the rigid locked condition of FIGS. 3 and 4, to the initial buckled or collapsed release condition in which a link coupler 158 and links 168,170 are pivotally moved as shown in FIG. 5. With initial release of the linkage mechanism 54, the mounting frame 50 begins to be slidably pulled back in the direction of arrow 22 relative to the rail 12 and the I-beams 20, With initial release of the linkage mechanism 54, the shock absorber 52 on mounting frame 50 is also pulled back so that the additive force of the compressed springs 112 and 124 is released in the direction opposite arrow 22 and applied to the piston rod 120, the tube 114, the connecting rod 46 and the wing 48 to reset these elements to their positions shown in FIG. 3. In the example shown, the return force of spring 112 acts primarily to return the piston rod 120, the tube 114, the connecting rod 46 and the wing 48 to their FIG. 3 position assisted secondarily by the return force of spring 124.

Figure 6:
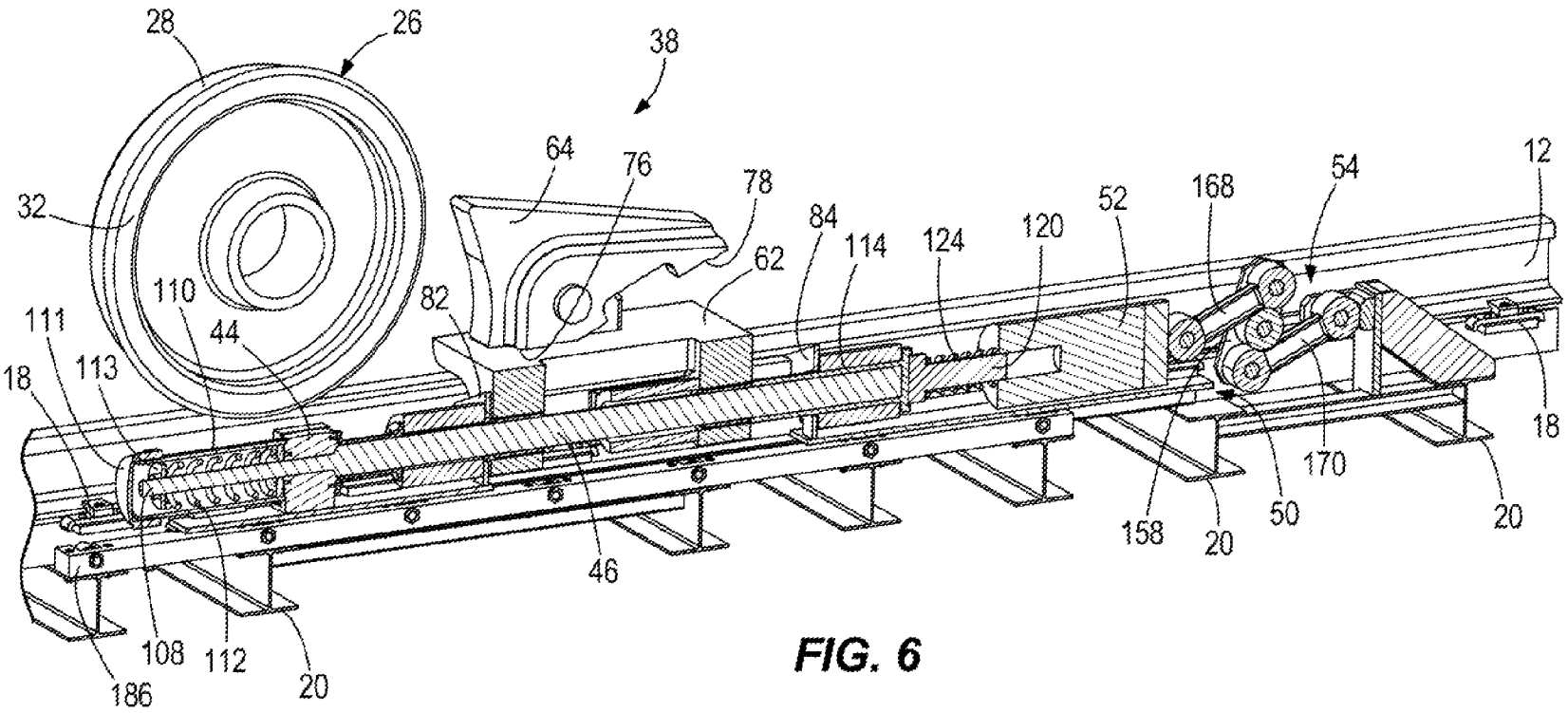
FIG. 6 is a view similar to FIG. 3 showing the railcar stop being disengaged from the railcar wheel.
Figure 11:
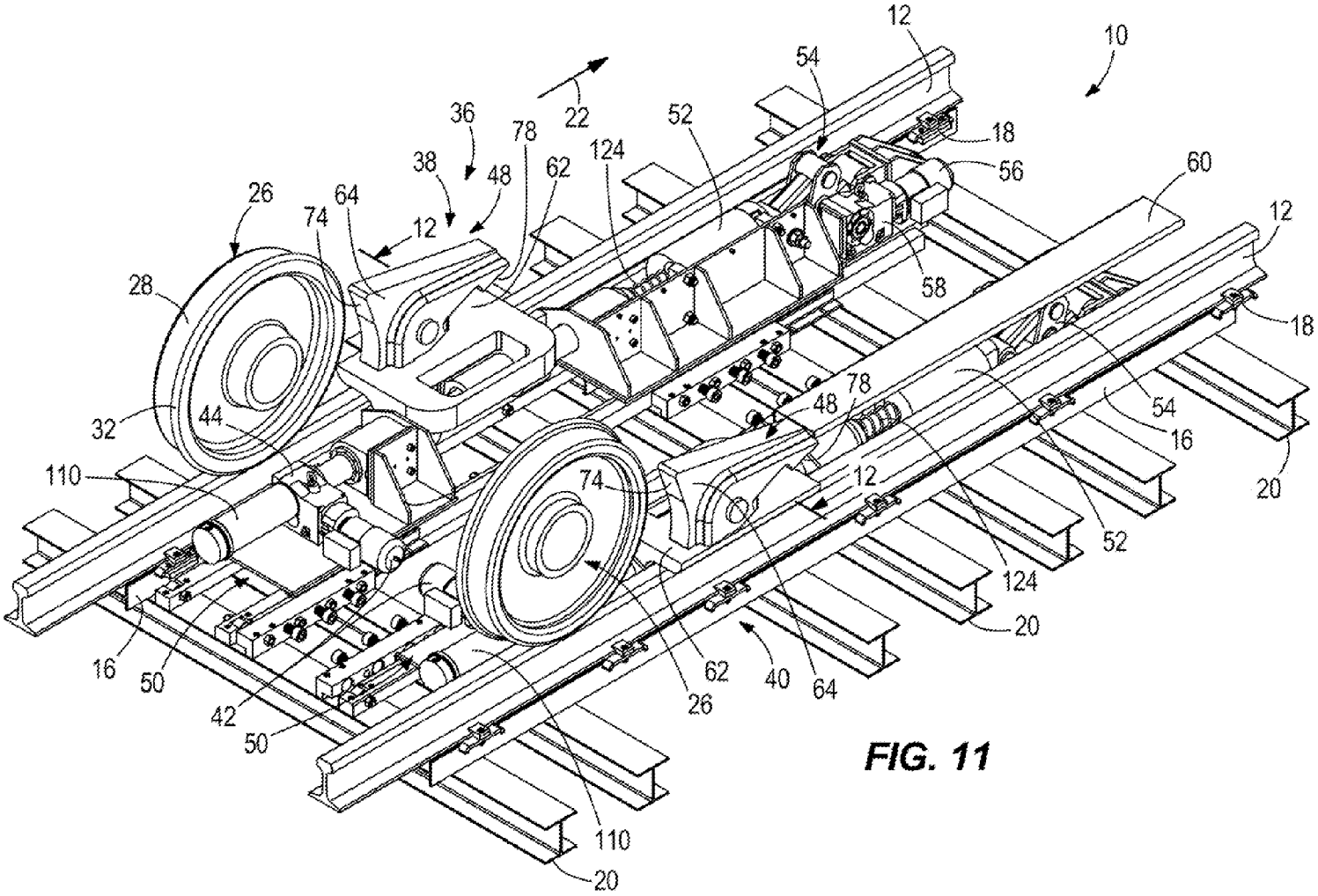
FIG. 11 is a perspective view of the system corresponding to FIG. 6.

With continued movement of the linkage 54 to a fully collapsed condition shown in FIGS. 6 and 11, the mounting frame 50 is further pulled rearwardly in the direction of arrow 22. Rearward movement of the mounting frame 50 results in the rearwardly moving front plate 82 engaging the front end of wing base 62 which, in turn, causes disengagement of the fin 64 from the wheel 26. Once the fin 64 is adequately separated from wheel 26 as described above, the fin 64 assumes its first position as described above with the rear abutment surface 78 biased upwardly from the base 62.

At this point, the wing 48 of the device 38 can be moved to the lowered position of FIG. 13 by energizing the gear motor 42 to drive the gearbox 44 such that the connecting rod 46 is rotated in the direction of arrows 232, 234 along, with the wing 48 which is operatively connected to the connecting rod 46. It should be appreciated that during the lowering of the wing 48, the springs 112 and 124 remain in continuous engagement with the connecting rod 46 so that the rod 46 and the connected wing 48 are constantly biased to the forward-most position shown in FIG. 3. Once the uppermost portion 224 of the wing 48 is beneath the travel path of the railcar, the wing 48 and the device 38 is fully rotated to its lowered position. The gear motor 56 of the device 38 is again actuated to return the linkage mechanism 54 to its locked position and return the mounting frame 50 to its initial position as shown in FIGS. 1 and 3. During movement of the linkage mechanism 54, the gear motor 56 and the gearbox 58 secured on movable base 222 (FIG. 1) slide back and forth relative to the mounting frame 50.

It should be recognized by those skilled in the art that the device or railcar stop 40 has structure and function which is identical to the device of railcar stop 38 described above, and that the system 36 contemplates the simultaneous operation of the devices 38, 40 for controlling travel of a railcar along a section of track 10.

What is claimed is:

1. A device for controlling travel of a railcar along a rail structure, the railcar comprising wheels having treads that ride on the rail structure, the device comprising:

a railcar stop that is selectively movable by a first drive arrangement between a first position wherein the railcar stop is disengaged from the rail structure and the tread of at least one of the wheels so that the railcar is free to travel along the rail structure, and a second position wherein the railcar stop is engaged with the rail structure, and configured to engage the tread of at least one of the wheels to thereby stop and prevent travel of the railcar in at least a first direction along the rail structure;

wherein the railcar stop is configured to be selectively movable by a second drive arrangement independent of the first drive arrangement and slidable on the rail structure in the first direction from the second position to a third position wherein the railcar stop is disengaged from the tread of the at least one of the wheels.

2. The device of claim 1, wherein the railcar stop comprises a wing pivotable between an active position wherein the railcar stop is movable between the second and third positions, and an inactive position wherein the railcar stop is movable to the first position.

3. The device of claim 2, wherein the wing is one of a pair of wings that are oppositely oriented with respect to each other and disposed between a pair of rails, each wing being pivotable into the first position between the pair of rails and into the second position above one of the rails on the pair of rails.

4. The device of claim 2, wherein each wing is constructed with a base and includes a fin pivotally mounted to the base, and that is engaged with the tread of the at least one wheel in the second position and disengaged from the tread of the at least one wheel in the third position.

5. The device of claim 2, wherein the railcar stop comprises a pivotable and slidable connecting rod coupled to the wing wherein pivoting of the connecting rod causes the wing to move between the first and second positions, and sliding of the connecting rod causes the wing to move between the second and third positions.

6. The device of claim 5, wherein the railcar stop comprises a shock absorber in continuous biasing engagement with the connecting rod such that the shock absorber constantly biases the connecting rod and the wing coupled to the connecting rod in a second direction opposite the first direction when the railcar stop is in the first, second and third positions.

7. The device of claim 6, wherein the shock absorber includes a piston rod extendable and retractable relative to a recess of the shock absorber, and a spring positioned between a head of the piston rod and a casing of the shock absorber.

8. The device of claim 6, wherein the railcar stop comprises the first drive arrangement configured in driving relationship with the connecting rod, and configured to move the wing between the first and second positions.

9. The device of claim 8, wherein the railcar stop comprises the second drive arrangement operably connected to the shock absorber, and configured to selectively move the wing from the second position to the third position independent of the first drive arrangement.

10. The device of claim 9, wherein the railcar stop comprises a linkage mechanism operably connected between the shock absorber and the second drive arrangement, the linkage mechanism being configured to move between a locked condition and a release condition.

11. The device of claim 9, wherein the railcar stop comprises a mounting frame mounted for longitudinal movement relative to the rail structure, the mounting frame being connected to the second drive arrangement such that selective operation of the second drive arrangement will cause engagement between the mounting frame and the wing to thereby disengage the wing from the tread of the at least one of the wheels.

12. The device of claim 11, wherein the wing, the connecting rod, the shock absorber, the linkage mechanism, the first drive arrangement and the second drive arrangement are mounted on the mounting frame.

13. The device of claim 11, wherein the second drive arrangement is slidably mounted relative to the mounting frame.

14. A device for controlling travel of a railcar along a set of rails, the railcar comprising wheels having treads that ride on the rails, the device comprising:

a railcar stop that is selectively movable between a first position wherein the wheel is free to travel on the rails and a second position wherein the railcar stop is configured to engage the tread of at least one of the wheels to thereby stop and prevent travel of the railcar in at least a first direction along the rails;

wherein the railcar stop comprises a pivotable rod coupled to at least one wing, wherein pivoting of the rod in one direction causes the wing to move from the first position to the second position in which the wing is engaged with the tread of the at least one wheel, and wherein pivoting the rod in the other direction causes the wing to pivot from the second position to the first position; and wherein the railcar stop comprises a mounting frame mounted for movement relative to the rails and mounting the rod and the wing thereon, the mounting frame being configured to selectively engage and move the wing in the first direction along the rails from the second position to a third position to thereby disengage the wing from the tread of the at least one of the wheels.

15. The device of claim 14, wherein the mounting frame is constructed with a pair of spaced apart front and rear plates, and the wing is pivotably and slidably mounted for movement between the front and rear plates.

16. The device of claim 14, wherein the set of rails is mounted on a pair of elongated beams that are transversely secured to a set of I-beams, and the mounting frame is mounted for slidable motion relative to the elongated beams and the I-beams.

17. The device of claim 14, wherein the mounting frame is mounted for slidable motion by means of a roller arrangement secured to the I-beams.

18. The device of claim 17, wherein the mounting frame includes an arrangement for restricting upward and lateral movement during slidable motion of the mounting frame.

19. A device for controlling travel of a railcar along a rail structure, the railcar comprising wheels having treads that ride on the rail structure, the device comprising:

a railcar stop that is selectively movable between a first position wherein the railcar is free to travel along the rail structure, and a second position wherein the railcar stop is configured to engage the tread of at least one of the wheels to thereby stop and prevent travel of a railcar in at least a first direction along the rail structure;

wherein the railcar stop comprises a pivotable rod coupled to at least one wing, wherein pivoting of the rod in one direction causes the wing to move from the first position to the second position in which the wing is engaged with the tread of the at least one of the wheels and wherein pivoting the rod in the other direction causes the wing to pivot from the second position to the first position;

wherein the railcar stop comprises a shock absorber in continuous biasing engagement with the connecting rod such that the shock absorber constantly biases the connecting rod and the wing coupled to the connecting rod in a second direction opposite the first direction when the wing is in the first and second positions, and wherein the shock absorber is mounted on a mounting frame configured for sliding back and forth movement relative to the rail structure.

20. The device of claim 19, wherein the shock absorber includes a piston rod that is extendable and retractable into a recess of the shock absorber, and a spring positioned between a head of the piston rod and a casing of the shock absorber.

21. The device of claim 19, wherein the rod and the wing are slidable along the rail structure in the first direction from the second position to a third position to thereby disengage the wing from the tread of the at least one of the wheels.

22. A system for controlling travel of a railcar over a set of rails, the railcar having wheels provided with treads that ride on the rails, the system comprising:

a railcar stop that is selectively movable relative to the rails between a first position wherein the railcar is free to travel along the rails, and a second position wherein the railcar stop is configured to engage the tread of at least one of the wheels to thereby stop and prevent travel of the railcar in at least a first direction along the rails, the railcar stop being selectively movable in the first direction along the rails from the second position to a third position to thereby disengage the railcar stop from the tread of the at least one of the wheels;

a first drive arrangement coupled to the railcar stop and configured to move the railcar stop between the first and second positions; and a second drive arrangement coupled to the railcar stop and configured to move the railcar stop from the second position to the third position independently of the first drive arrangement.

23. The system of claim 22, wherein the railcar stop is one of two railcar stops, one railcar stop being engageable with one rail of the set of rails and the other railcar stop being engageable with another rail of the set of rails, wherein each railcar stop is movable between the first, second and third positions.

24. The system of claim 22, wherein each of the first and second drive arrangements comprises a gear motor coupled to a gearbox.

25. A system for controlling travel of a railcar along a set of rails, the railcar having wheels provided with treads that ride on the rails, the system comprising:

a railcar stop that is selectively movable relative to the rails between a first position wherein the railcar is free to travel along the rails and a second position wherein the railcar stop is configured to engage a tread of at least one of the wheels to thereby stop and prevent travel of the railcar in at least a first direction along the rails;

a pivotable rod coupled to at least one wing wherein pivoting of the rod in one direction causes the wing to move from the first position to the second position in which the wing is engaged with the tread of the at least one wheel, and whereby pivoting the rod in the other direction causes the wing to pivot from the second position to the first position;

a shock absorber in continuous biasing engagement with the connecting rod such that the shock absorber constantly biases the connecting rod and the wing coupled to the connecting rod in a second direction opposite the first direction when the wing is in the first and second positions; and a mounting frame mounted for movement relative to the rails and a stationary frame, and mounting the rod, the wing and the shock absorber thereon, the mounting frame being configured to selectively engage and move the wing in the first direction along the rails from the second position to a third position to thereby disengage the wing from the tread of the least one of the wheels.

26. The system of claim 25, wherein the railcar stop further comprises a first drive arrangement configured to move the rod and the wing between the first and second positions, and a second drive arrangement configured to selectively move the rod and the wing from the second position to the third position.

27. The system of claim 26, wherein a linkage mechanism is interconnected between the shock absorber and the second drive arrangement, and is movable between a rigid locked condition and a collapsed release condition.

28. The system of claim 27, wherein the linkage mechanism includes a link coupler and a pair of links pivotally connected to the link coupler.

29. The system of claim 28, wherein the link coupler is drivingly connected to the second drive arrangement, one of the links is connected to the shock absorber and the other of the links is connected to a bracket arrangement anchored to the stationary frame.

30. The system of claim 26, wherein the shock absorber includes a piston rod movable into and out of a recess of the shock absorber, and a first spring positioned between a head of the piston rod and a casing of the shock absorber, and wherein a second spring is positioned between a forward extremity of the pivotable rod and the first drive arrangement, the first and second springs constantly biasing the rod and the wing in a second direction opposite the first direction when the wing is in the first and second positions.

31. A method for controlling travel of a railcar along a rail structure, the railcar comprising wheels having treads that ride on the rail structure, the method comprising the steps of:

a) providing a railcar stop that is selectively movable by a first drive arrangement between a first position disengaged from the rail structure wherein the railcar is free to travel along the rail structure, and a second position engaged with the rail structure wherein the railcar stop is configured to engage the tread of at least one of the wheels to thereby stop and prevent travel of the railcar in at least a first direction along the rail structure; and b) selectively drive the railcar stop by a second drive arrangement independent of the first drive arrangement and slidable on the rail structure in the first direction along the rail structure from the second position to a third position disengaged from the tread of the at least one of the wheels.

32. A device for controlling travel of a railcar along a set of rails, the railcar comprising wheels having treads that ride on the rails, the device comprising:

a railcar stop that is selectively movable between a first position wherein the railcar is free to travel along the rails, and a second position wherein the railcar stop is configured to engage the tread of at least one of the wheels to thereby stop and prevent travel of the railcar in at least a first direction along the rails;

wherein the railcar stop is configured to be selectively movable in the first direction along the rails from the second position to a third position to thereby disengage the railcar stop from the tread of the at least one of the wheels, wherein the railcar stop comprises a wing pivotable between an active position wherein the railcar stop is movable between the second and third positions, and an inactive position wherein the railcar stop is movable to the first position, wherein the railcar stop comprises a pivotable and slidable connecting rod coupled to the wing wherein pivoting of the connecting rod causes the wing to move between the first and second positions, and sliding of the connecting rod causes the wing to move between the second and third positions, wherein the railcar stop comprises a shock absorber in continuous biasing engagement with the connecting rod such that the shock absorber constantly biases the connecting rod and the wing coupled to the connecting rod in a second direction opposite the first direction when the railcar stop is in the first, second and third positions, wherein the railcar stop comprises a first drive arrangement configured in driving relationship with the connecting rod, and configured to move the wing between the first and second positions, and wherein the railcar stop comprises a second drive arrangement operably connected to the shock absorber, and configured to selectively move the wing from the second position to the third position independent of the first drive arrangement.

* * * * *